US005090427A

United States Patent [19]

Sherts

[11] Patent Number: 5,090,427

[45] Date of Patent: Feb. 25, 1992

[54] FINGER GROOMER ATTACHMENT FOR WRITING INSTRUMENTS

[76] Inventor: Charles Sherts, 70 Washington St., Norwalk, Conn. 06854

[21] Appl. No.: 639,122

[22] Filed: Jan. 9, 1991

[51] Int. Cl.[5] ..... A45D 29/04

[52] U.S. Cl. ..... 132/75.6; 132/75.3; 132/73.5; 401/195

[58] Field of Search ..... 132/73, 73.5, 75.3, 132/75.6, 76.4, 76.5, 76.2; 401/195

[56] References Cited

U.S. PATENT DOCUMENTS

| | | | |
|---|---|---|---|
| 1,040,446 | 10/1912 | Smith | 132/76.2 |
| 1,367,975 | 2/1921 | Ivory | 132/76.2 |
| 1,478,049 | 12/1923 | Nelson | 132/75.6 |
| 1,655,452 | 1/1928 | Ament | 401/195 |
| 1,663,089 | 3/1928 | McFarland | 132/73.5 |
| 2,075,932 | 4/1937 | Ehrmann | 401/195 |
| 2,441,673 | 5/1948 | Salg | 132/76.2 |
| 2,841,156 | 7/1958 | Herald | 132/76.4 |

FOREIGN PATENT DOCUMENTS

| | | | |
|---|---|---|---|
| 0017252 | of 1908 | United Kingdom | 132/76.2 |

*Primary Examiner*—Cary E. Stone
*Assistant Examiner*—Adriene B. Lepiane
*Attorney, Agent, or Firm*—Handal & Morofsky

[57] ABSTRACT

A finger groomer attachment for a writing instrument is disclosed. The inventive device that performs a variety of manicure operations, and can be used to secure a writing instrument to an item, such as a shirt pocket to protect the writing part of a writing instrument from damage and to protect against unwanted marks made by an unprotected writing point while at the same time guarding against fouling of the instrument. The inventive device incorporates a fingernail cleaner for cleaning under fingernails, a pocket-clip for attaching a writing instrument to an item such as a shirt pocket, a cuticle pusher for pushing back the cuticle of a finger, and an abrasive strip for shaping of the fingernails. These are conveniently incorporated into a durable and easy to manufacture attachment which fits on a variety of writing instruments.

13 Claims, 3 Drawing Sheets

FINGER GROOMER ATTACHMENT FOR WRITING INSTRUMENTS

TECHNICAL FIELD

The present invention relates to a finger groomer, including a finger nail cleaner, a cuticle pusher and an abrasive strip for nail shaping, attachable to a writing instrument and method for making the same.

BACKGROUND

There are numerous multifunction devices incorporating manicure instruments, such as nail files, cuticle pushers, and finger nail cleaners. However, these devices are relatively small and due to the infrequency with which they are used are prone to being misplaced or lost.

Since early on in the development of modern writing instruments, a cap of some kind has been included with the instrument.

The presence of the cap on pens has spurred attempts to improve on manicure instruments and writing instrument caps by combining their functional aspects into a single device. For example, some have incorporated a blade or manicure attachment that is housed within the cap and may be projected therefrom as disclosed in U.S. Pat. No. 1,725,064 to Easton. However, the number of parts and their relationship makes assembly complex and expensive. In similar fashion, U.S. Pat. No. 2,075,932 to Ehrmann discloses a cap which has a slidably mounted retaining clip which when slid up reveals an abrader. While relatively simple in its construction, U.S. Pat. No. 2,841,156 to Herald discloses a pen cap with a slidably mounted nail file held in place on the pen clip by a thin peripheral retainer. However, the exposed abrader is easily fouled by clothing fibers and the like when the pen contacts wooly clothing or the like. Finally, U.S. Pat. No. 2,110,999 to Miga discloses a manicure attachment for a writing instrument in which the cap is used as a sheath to cover the fixed mounted attachment, leaving the writing tip unprotected, and rendering the arrangement less than ideal for a pencil and unacceptable for use with a pen.

All of the above prior art fails to adequately solve the problem of providing a convenient manicuring instrument incorporated into an attachment to a writing instrument. Thus, each of the prior art systems is inadequate to effectively solve the subject problem because its design inherently contains one or more of the following disadvantages, namely, 1) expensive to produce, 2) complicated design, 3) non-adaptability to various writing instruments, and 4) not providing a clip portion for attachment of the writing instrument to an item such as a shirt sleeve.

SUMMARY OF THE INVENTION

The inventive finger groomer attachment for writing instruments solves the problem of providing an inexpensive manicure attachment conveniently incorporated into a cap for writing instruments.

The inventive device uses a simple design to provide an easy to manufacture device that performs a variety of manicure operations, and can be used to secure a writing instrument to an item, such as a shirt pocket. It also protects the writing part of a writing instrument from damage and protects against unwanted marks made by an unprotected writing point.

The inventive device incorporates a fingernail cleaner for cleaning under fingernails, a pocket-clip for attaching the writing instrument to an item such as a shirt pocket, a cuticle pusher for pushing back the cuticle of a finger, and an abrasive strip for shaping a fingernail. These are conveniently incorporated into a durable and easy to manufacture attachment which can be incorporated into a variety of writing instruments.

Alternatively, the pocket-clip can be formed from metal and attached to an injection molded cap. The pocket-clip can have a strip of abrasive adhered to it or the abrasive surface can be formed by etching intersecting grooves on the top surface of the pocket-clip.

In accordance with the preferred embodiment, the cuticle pusher is made in the form of a human finger tip. Thus, the user is visually made aware of the intended use of the device, without the need for written description.

Yet another alternative is to incorporate cut-outs around the opening of the cap so the cap becomes universally retrofitable and can expand and accept writing instruments with a diameter greater than the diameter of the opening.

BRIEF DESCRIPTION OF THE DRAWINGS

One way of carrying out the invention is described in detail below with reference to drawings which illustrate only one specific embodiment of the invention and in which:

FIG. 2(*b*) is a view along lines 2*a*–2*a* of FIG. 2(*a*);

BEST MODE FOR CARRYING OUT THE INVENTION

Figure 1:
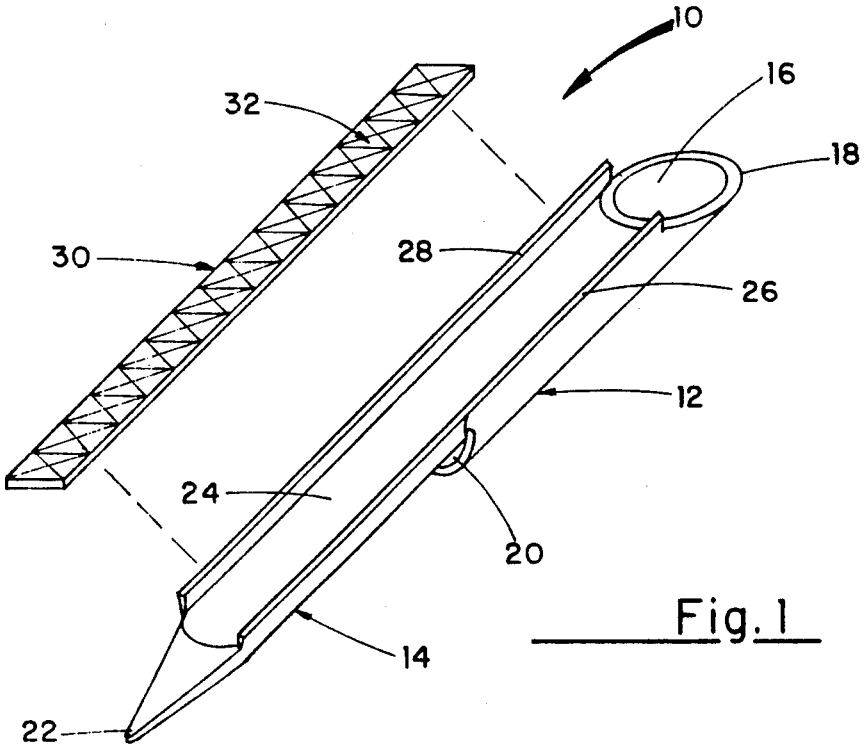
FIG. 1 is an exploded perspective view illustrating the construction of the inventive finger groomer attachment for writing instruments.
Figure 2A:
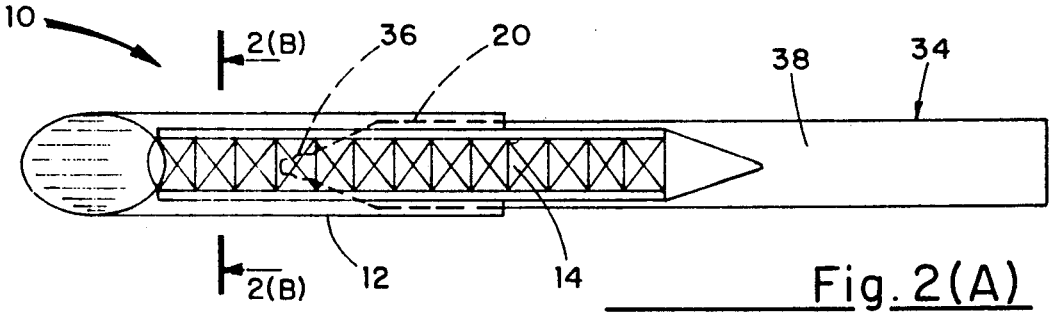
FIG. 2(*a*) is a top plan view of the inventive finger groomer attachment for writing instruments on a writing instrument.
Figure 2B:
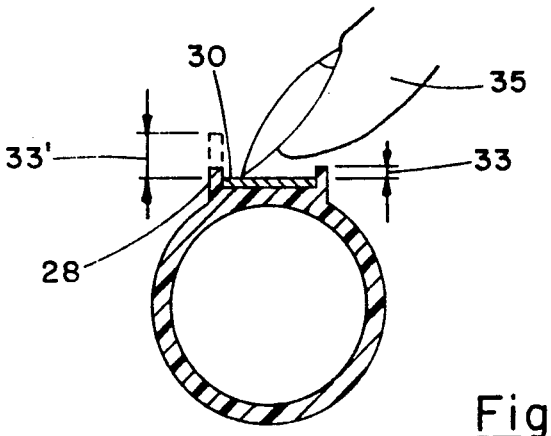

Referring to FIGS. 1, 2(*a*) and 2(*b*), the inventive finger groomer attachment for writing instruments 10 includes hollow tubular member 12 and clip portion 14. Hollow tubular member 12 terminates at one end in cuticle pusher 16. Cuticle pusher 16 has a sharp edge 18 for pushing back the cuticle on a fingernail. Hollow tubular member 12 terminates at the other end with a circular orifice 20 configured and dimensioned to matingly engage a writing instrument. Clip portion 14 terminates in pointed portion 22. Pointed portion 22 is thin and pointed to scrape underneath a fingernail to remove dirt and foreign matter. Top surface 24 extends along the top of hollow tubular member 12 and clip portion 14. On either side of top surface 24 are raised ridge members 26 and 28. An abrasive member 30 is secured to surface 24 and has a flexible substrate such as paper, polymer tape, cloth or the like covered with carborundum particles. An adhesive disposed on one side secures it to surface 24. An abrasive surface 32 disposed on the other side of member 30 provides its desired functional characteristics. Abrasive surface 32, can also be formed of garnet, emery, flint, silicon carbide, aluminum oxide or the like.

Abrasive member 30 is dimensioned to fit between raised ridge members 26 and 28 and extend the length of top surface 24. As noted above, abrasive member 30 is secured to top surface 24; this may be done using an adhesive or pressure sensitive adhesive such as cyanoacrylate, acrylic, latex, gum base adhesive, or the like. Raised protective ridge members 26 and 28 are raised up from top surface 24 a distance that is greater than the thickness of abrasive member 30 (FIG. 2(*b*)) so as to provide a channel to guide abrasive member 30 on to top surface 24 during assembly.

This also prevents abrasive surface 32 from coming into contact with items such as the lining of a suit, table tops, etc., when inventive device 10 is in use as a cap for a writing instrument.

In accordance with the preferred embodiment, protective ridge members 26 and 28 extend above abrasive surface 32 by distance 33 of at least 1/32 of an inch to provide a measure of separation between the abrasive surface and, for example, the wooly insides of a tweed jacket lapel, when a pen with the inventive clip is worn in the shirt pocket. More effective protection against fouling of the adhesive can be obtained by increasing distance 33 to 1/16 inch.

Alternately, ridge 28 may be made longer than ridge 26, as illustrated in phantom lines in FIG. 2(*b*). This allows the finger 35 of a user substantially unobstructed access, even in the case of relatively short fingernails, while providing a very effective and high protective ridge 33 which acts to deflect clothing away from the abrasive surface which extends to the other ridge 26. As illustrated in FIG. 2(*b*), it is intended that the user smooth the nail tip by positioning the finger with the skin adjacent shorter ridge 26.

The inventive finger groomer attachment 10 is used for protection of writing instrument 34 as shown. Writing point 36 is located at one end of barrel 38 of writing instrument 34 and is engagingly accepted by circular orifice 20. Inventive finger groomer attachment for writing instruments 10 may be temporarily secured to writing instrument 34 by friction between the surfaces of hollow tubular member 12 in contact with the outside surface of barrel 38. As with conventional writing instrument caps, writing instrument 34 is secured to an item such as a shirt pocket, by the action of spring tension of clip portion 14 squeezing item, such as fabric of a shirt pocket, between clip portion 14 and barrel 38.

Alternative embodiments are illustrated in FIGS. 3–7, Generally, similar parts or parts performing analogous, corresponding or identical functions to those of the FIG. 1 embodiment are numbered herein with numbers which differ from those of the earlier embodiment by multiples of one hundred.

Figure 3:
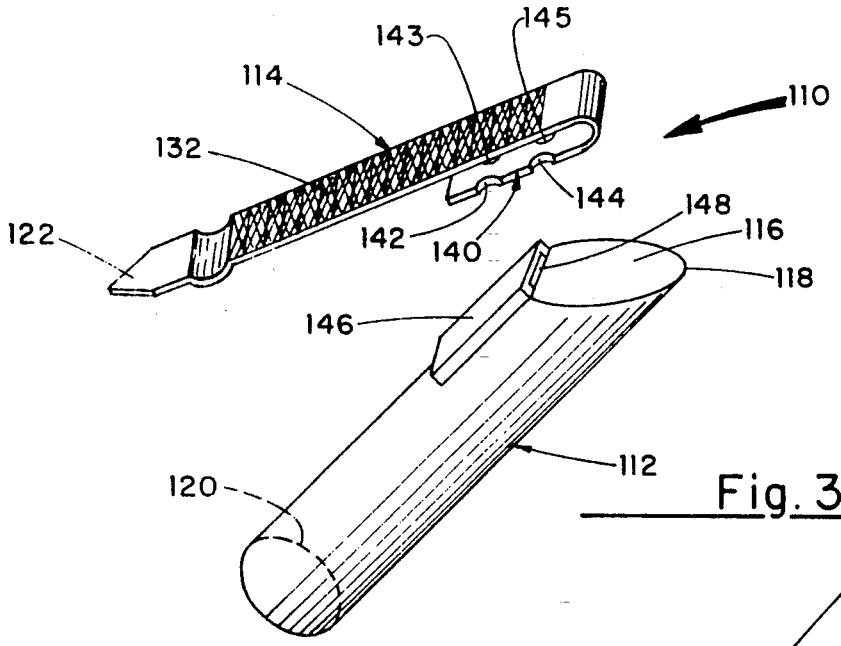
FIG. 3 is an exploded perspective view illustrating the construction of one alternative embodiment of the inventive finger groomer attachment for writing instruments.

Referring to FIG. 3, one alternative embodiment of inventive finger groomer attachment for writing instruments 110 comprises a hollow tubular member 112 and a clip portion 114. Hollow tubular member 112 terminates at one end with a cuticle pusher 116. Cuticle pusher 116 has a sharp edge 118 for pushing back the cuticle on a fingernail. Hollow tubular member 112 is terminated at the other end by a circular orifice 120 configured and dimensioned to matingly engage a substantially cylindrical shaped writing instrument and be retained thereon by friction.

Clip portion 114 terminates at one end in a pointed portion 122. Pointed portion 122 is configured and dimensioned to scrape underneath a fingernail to remove dirt and foreign matter.

Clip portion 114 may be made from a spring metal or the like and has an abrasive surface 132. Abrasive surface 132 can be made, for example, by etching intersecting grooves into the top surface of clip portion 114.

Figure 4:
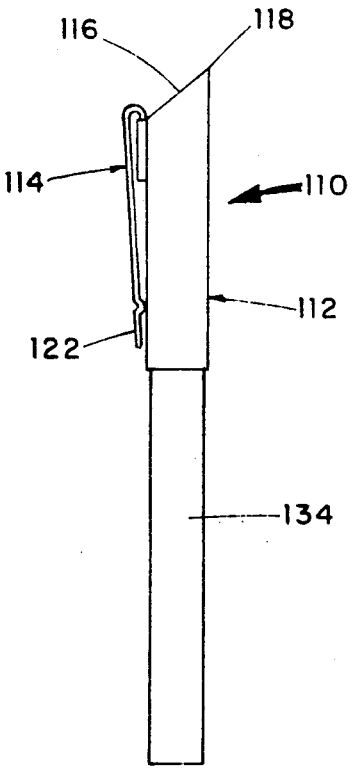
FIG. 4 is a top plan view of the alternative embodiment of FIG. 3 of the inventive finger groomer attachment for writing instruments on a writing instrument.

Clip portion 114 terminates at the other end in attachment portion 140. Attachment portion 140 has notches 142 and 144 disposed along one edge and notches 143 and 145 similarly disposed along its other edge. Hollow tubular member 112 has a clip portion support member 146 disposed on its top surface. Clip portion support member 146 has an orifice configured and dimensioned to matingly engage attachment portion 140. Once assembled, notches 142, 143, 144 and 145 prevent clip portion 114 from slipping out. Referring to FIG. 4, the inventive finger groomer attachment 110 is illustrated attached to a writing instruments 134. Attachment 110 is secured to the writing instrument 134 in a similar manner to that disclosed in the FIG. 2(*a*) above. When assembled, semicircular surface 148 is urged against hollow tubular member 112. Attachment 110 and writing instrument 134 may be secured to an item, such as a shirt pocket, by the spring action of clip portion 114.

Figure 5:
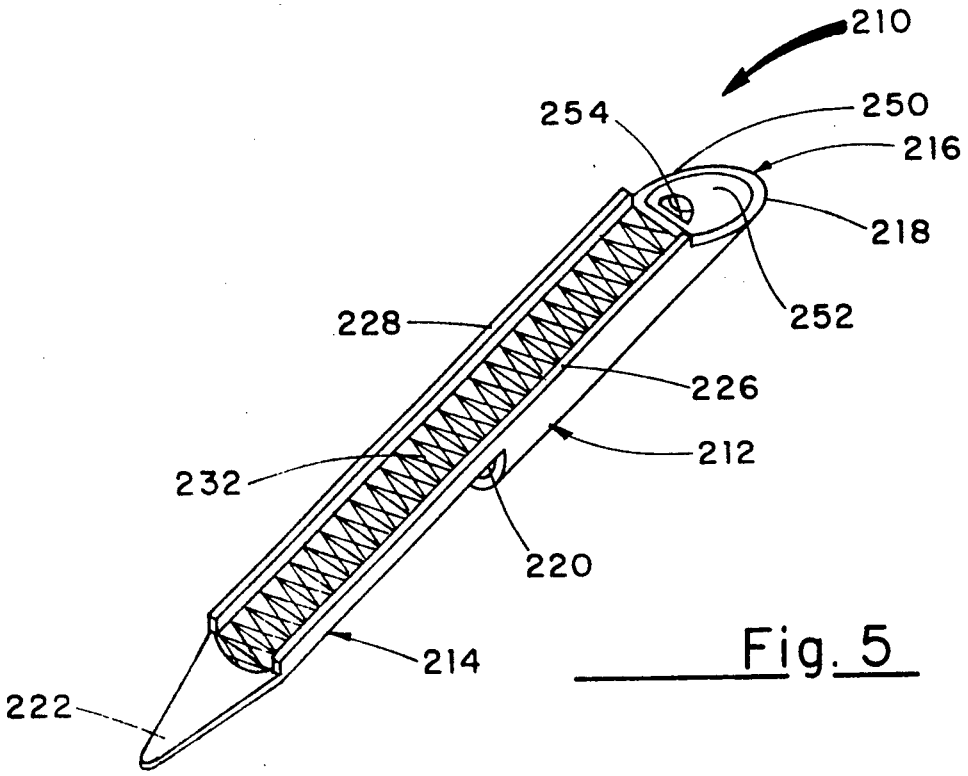
FIG. 5 is a perspective view illustrating the construction of another alternative embodiment of the inventive finger groomer attachment for writing instruments.

Referring to FIG. 5, another alternative embodiment of inventive finger groomer attachment for writing instruments 210 is shown. In addition to the inventive features described in the above first two embodiments of the inventive device, this embodiment includes a likeness of a human finger tip 250, including a likeness of fingernail 252, and skin ridges 254 to create the appearance of a human finger tip disposed on cuticle pusher 216. The appearance of the finger tip provides the user with a visual connection between the device and its intended function as a finger groomer without the need for written instructions.

Figure 7:
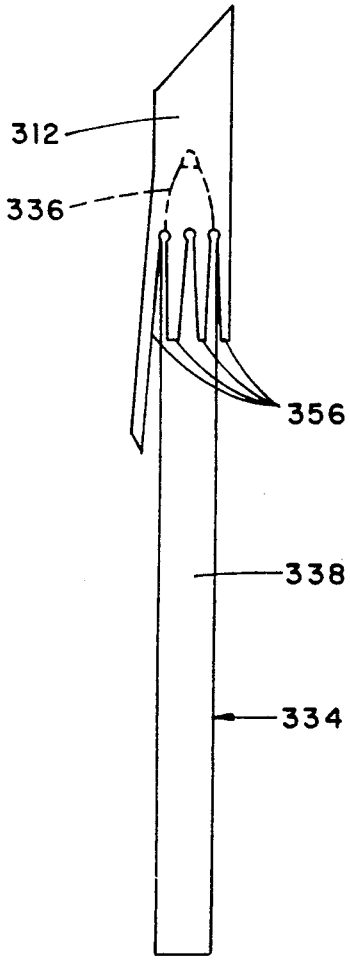
FIG. 7 is a top plan view of the alternative embodiment of FIG. 6 of the inventive finger groomer attachment for writing instruments on a writing instrument.
Figure 6:
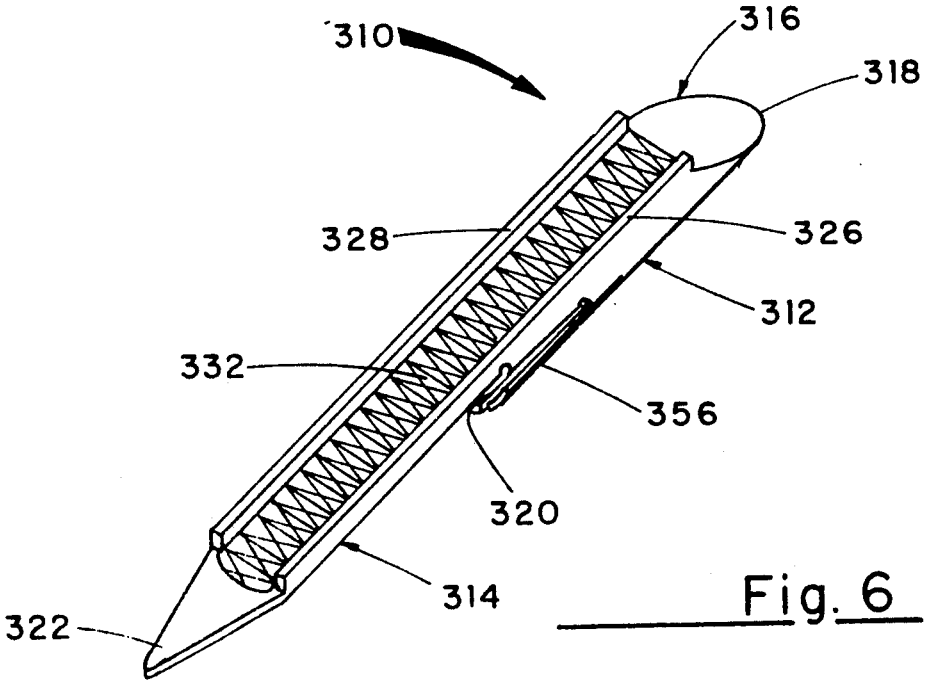
FIG. 6 is a perspective view illustrating the construction of yet another alternative embodiment of the inventive finger groomer attachment for writing instruments.

Referring to FIGS. 6 and 7, yet another alternative embodiment of the inventive finger groomer attachment for writing instruments 310 is disclosed. In addition to the inventive features of the previous three embodiments, this embodiment includes a plurality of expansion cut-outs 356 disposed around the circumference of hollow tubular member 312. When writing instrument 334, whose barrel circumference is greater than the circumference of circular orifice 320, is inserted into circular orifice 320, expansion cut-outs 356 allow hollow tubular member 312 to expand and accept and engage writing instrument 334 of size greater than the inner diameter of attachment 310.

INDUSTRIAL APPLICABILITY

The present invention is particularly suitable for application to modern industrial processes. In particular, referring to the embodiments disclosed in FIGS. 1, 5, and 6, the inventive device can be formed by an inexpensive one step injection molding process. The device can by molded from any suitable plastic, such as inexpensive polypropylene or polyethylene.

Referring to FIG. 1, raised ridge members 26 and 28, provide a channel which guides and facilitates the attachment of abrasive member 30 by hand assembly or automated machine assembly operations. Referring to FIGS. 3 and 4, clip portion 114 is formed by a separate metal stamping, etching and bending process. The rest of inventive device is formed, as in the other embodiments, by a single step injection molding process. Clip portion 114 is inserted into attachment portion 140 in a simple hand assembly or automated machine assembly operation.

The inventive attachment is preferably formed by injection molding using a high density polyethylene or high density polypropylene.

Preferably, the abrasive strip is comprised of an inexpensive, long lasting and flexible paper backed "sandpaper" type abrasive that resists clogging or wear, such as open coat silicon carbide, or aluminum oxide forming a sand paper with a grit size of 150–400. Bonding of the abrasive strip to the cap is done with a pressure sensitive acrylic based transfer adhesive or a liquid synthetic rubber. Such adhesives are easy to apply, flexible and will not dry, shrink or turn brittle over a life of several years.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. A finger groomer attachment for a writing instrument, comprising, a pen cap having an outer surface, an open end for receiving a writing instrument and a closed end formed in a point and mimicking the appearance of a human finger and configured to push a cuticle during finger grooming, a clip disposed on said outer surface of said cap and secured to said cap at one end, a fingernail cleaner point forming the other end of said clip, an abrasive surface for fingernail shaping being secured to a surface of said clip facing away from said cap.

2. A finger groomer attachment for a writing instrument as in claim 1, further comprising a plurality of cut-outs defined by said cap, said cut-outs starting at said open end and extending towards but not reaching said closed end.

3. A finger groomer attachment for a writing instrument, comprising (a) a cap body defining a tubular hollow volume having a longitudinal axis, a first end and a second end, and defining an engagement orifice at said second end, said orifice being dimensioned to engage a pen body;

b) a pen clip secured at one end to said cap and extending longitudinally from said first end of said cap toward said second end of said cap, said clip terminating in a point; and said clip having a surface which faces away from said cap body;

c) an abrasive material defining an abrasive surface and secured to said surface of said clip; and d) a cuticle pusher formed on said first end of said cap.

4. A finger groomer attachment for a writing instrument as in claim 3, wherein said cuticle pusher has a surface defined at an oblique angle relative to said longitudinal axis such that said cuticle pusher has a substantially oval shape.

5. A finger groomer attachment for a writing instrument, as in claim 3, wherein said abrasive material defines an abrasive strip having longitudinal edges, said abrasive strip extending substantially from said point of said clip to said cuticle pusher at said first end.

6. A finger groomer attachment for a writing instrument as in claim 3 wherein said abrasive material is a strip of abrasive material further comprising:

e) first and second elongated raised ridge members, one of said raised ridge members being positioned adjacent a longitudinal edge of said abrasive strip, and the other of said raised ridge members being positioned adjacent to an opposite longitudinal edge of said abrasive strip.

7. A finger groomer attachment for a writing instrument as in claim 6, wherein at least one of said raised ridge members extends away from and beyond said abrasive surface.

8. A finger groomer attachment for a writing instrument as in claim 7, wherein one of said raised ridge members extends further away from said abrasive surface than the other of said raised ridge members.

9. A finger groomer attachment for a writing instrument as in claim 6, wherein said abrasive surface comprises a flexible substrate made of paper, polymer tape, or the like with an abrasive material secured thereto.

10. A finger groomer attachment for a writing instrument as in claim 3, wherein said cuticle pusher is shaped in the likeness of a human fingertip.

11. A finger groomer attachment for a writing instrument as in claim 3, wherein said cap is made from a thermoplastic such as polypropylene, or polyethylene.

12. A finger groomer attachment for a writing instrument as in claim 3, wherein said abrasive surface is garnet, emery, flint, silicon carbide or aluminum oxide.

13. A finger groomer attachment for a writing instrument as in claim 3, wherein said abrasive surface comprises a paper backed adhesive secured by a flexible solvent based adhesive.

* * * * *